US005522522A

United States Patent [19]

Fukumoto

[11] Patent Number: 5,522,522

[45] Date of Patent: Jun. 4, 1996

[54] TANK LINED WITH A CHEMICAL-RESISTANT SHEET

[75] Inventor: Masafumi Fukumoto, Amagasaki, Japan

[73] Assignee: Nisshin Chemical Industry Co., Ltd., Amagasaki, Japan

[21] Appl. No.: 303,710

[22] Filed: Sep. 9, 1994

[30] Foreign Application Priority Data

Apr. 21, 1994 [JP] Japan ..... 6-083506

[51] Int. Cl.[6] ..... B65D 90/04

[52] U.S. Cl. ..... 220/403; 220/421; 220/461

[58] Field of Search ..... 220/452, 460, 220/461, 420, 421, 901, 424, 425, 442, 467, 468, 721, 723, 565; 206/524.8, 524.2; 137/583, 586, 587

[56] References Cited

U.S. PATENT DOCUMENTS

| | | | |
|---|---|---|---|
| 2,924,359 | 2/1960 | Beremand | 220/721 X |
| 3,348,728 | 10/1967 | Love | 220/461 |
| 3,711,621 | 11/1969 | Hansen | 220/461 |
| 3,747,800 | 7/1973 | Viland | 220/460 X |
| 3,942,331 | 3/1976 | Newman et al. | 220/421 X |
| 4,098,425 | 7/1978 | Yamamoto | 220/403 |

*Primary Examiner*—Steven M. Pollard
*Attorney, Agent, or Firm*—Schweitzer Cornman & Gross

[57] ABSTRACT

The invention relates to a lined tank having a tank body of a wall with an interior surface and an exterior surface, one or more exterior shells disposed over at least a part of the tank body, the exterior shell being separated by a clearance from the exterior surface, a plurality of penetration holes ranging through the wall into the clearance, a chemically resistant tank liner having a side adhesively attached to the interior surface, and suction ports in the exterior shell for enabling vacuum drawn through the suction ports to exert a negative pressure on the tank liner through the penetration holes.

7 Claims, 6 Drawing Sheets

TANK LINED WITH A CHEMICAL-RESISTANT SHEET

FIELD OF THE INVENTION

The present invention relates to a tank lined with a chemically resistant sheet, for storing various chemicals, including vacuum storage tanks, and drying and reaction vessels under reduced pressure.

BACKGROUND OF THE INVENTION

The interior surfaces of tanks for corrosive liquids are lined with a chemically resistant material such as polyvinyl chloride (PVC), rubber, a thermoplastic polytetrafluoroethylene (PTFE), and the like, to protect the inside wall of the tank. Frequently, when the pressure is reduced inside such a lined tank, the lining tends to separate from the interior wall of the tank and will render the tank unfit for further use.

In the prior art these problems were sought to be avoided by applying the tank line webbing to the interior surface of the tank without any adhesive and then pulling the line against the interior surface through a plurality of suction ports. Thus, the tank liner is tensioned through a balance of the inside and outside vacuums exerted on both sides of the lining.

Problems still remained with the foregoing arrangement. The suction from the exterior is exerted only on the parts of the lining that are nearest to the suction ports. This produces an unsatisfactory effect because parts of the lining that are remote from the suction ports are sucked inwardly. The portions of the lining that are sucked against the interior are also likely to peel off, and the entire lining will collapse into to the tank to an extent to render the tank unserviceable when the outside pressure reduction is interrupted for any reason.

BRIEF DESCRIPTION OF THE INVENTION

It is an object of the present invention to provide a tank lined with a chemically resistant webbing which is simply made to adhere to the interior wall of the tank under reduced pressure in the interior of the tank.

It is another object of the present invention to provide a tank lined with a chemically resistant webbing which is superior in reliability and durability to such lined tanks of the prior art, wherein the liner lies up evenly on the interior surface of the tank even when the interior is under substantial vacuum.

The present invention relates to a lined tank having a tank body of a wall with an interior surface and an exterior surface, one or more exterior shells disposed over at least a part of the tank body, the exterior shell being separated by a clearance from the exterior surface, a plurality of penetration holes ranging through the wall into the clearance, a chemically resistant tank liner having a side adhesively attached to the interior surface, and suction ports in the exterior shell for enabling vacuum drawn through the suction ports to exert a negative pressure on the tank liner through the penetration holes.

In a suitable embodiment of the present invention, separation of the interior lining is prevented by a tank having spaced, double bodies with an inner tank body having a chemically resistant lining adhesively attached to the interior surface thereof, and suction ports range through the wall of the inner body, through which the liner is sucked toward the space between the inner and outer tank bodies so that the vacuum applied to the inside of the lined tank is balanced out by the vacuum exerted on the exterior of the liner. Adhesion between the liner and the inside surface of the tank is suitably improved by a glass fiber webbing at the interface of the liner and the tank surface.

DESCRIPTION OF THE DRAWING

For a more complete understanding of the above and other features and advantages of the invention, reference is made to the following detailed description of the invention, and to the accompanying drawings, wherein.

DETAILED DESCRIPTION OF THE INVENTION

The embodiments of the present invention are described and illustrated herein-below in connection with gooch funnels, also known as Buchner funnels employed in vacuum tanks.

Figure 1:
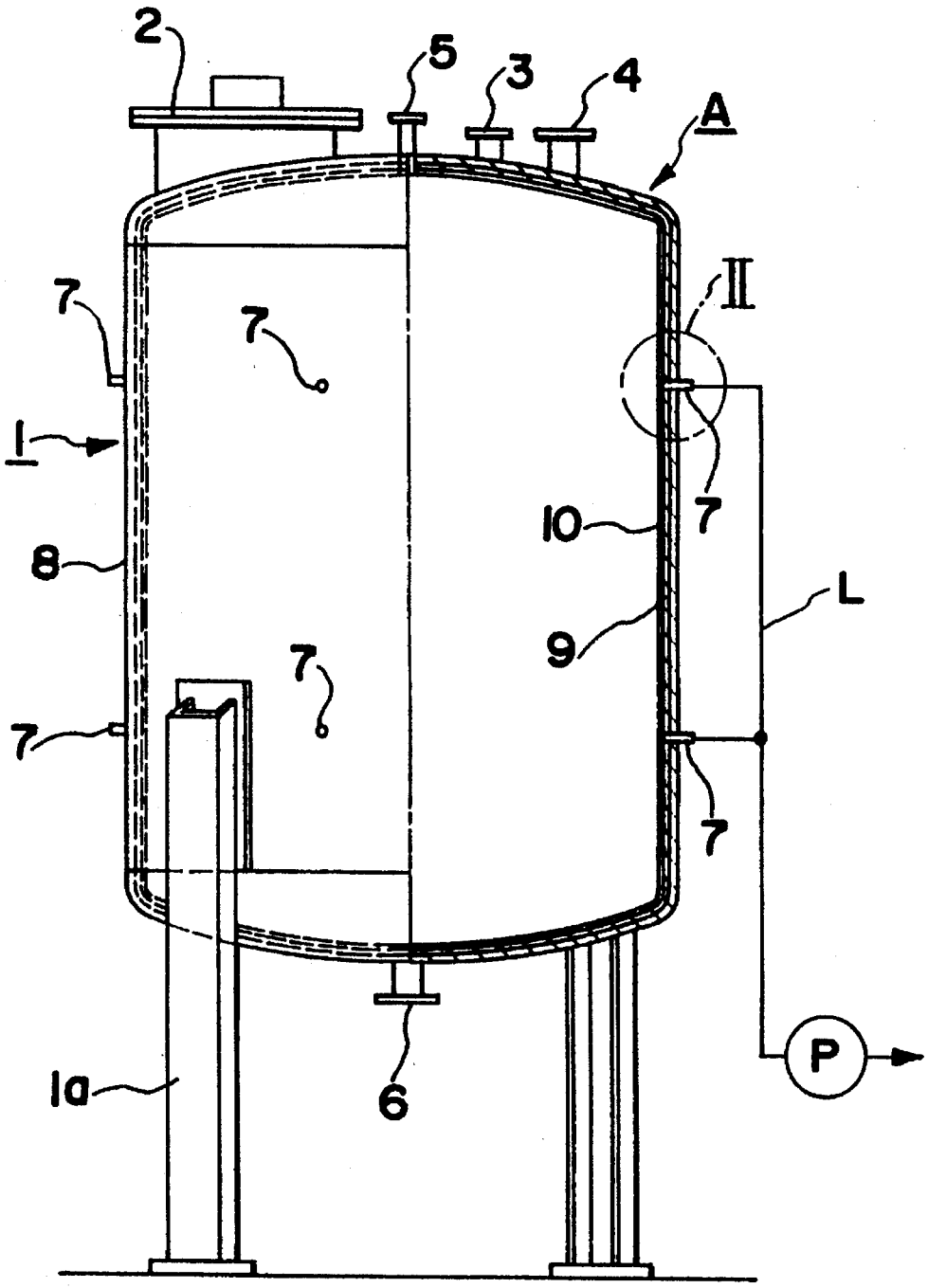
FIG. 1 is a partially cross-sectional elevational view of a first embodiment of the present invention applied to a vacuum tank.

The vacuum tank "A" of the first embodiment of the present invention as shown in FIG. 1, has a tank body 1 set upright and supported above the ground by legs 1*a*. The top of the tank body 1 is provided with a manhole 2, an air vent 3, a liquid inlet 4, and an air break port 5. The bottom of the tank body is provided with a liquid outlet 6. The outer circumference of the tank body is provided with a plurality of suction ports 7 at predetermined locations. The tank body 1 is formed as a double body structure of an exterior shell 8 of suitably 4 mm thick stainless steel, and an interior vessel 9, which are fastened to one another by spot welded spacers at selected locations. A chemically resistant liner 10 is adhesively applied to the entire interior wall of the interior vessel 9.

Figure 2:
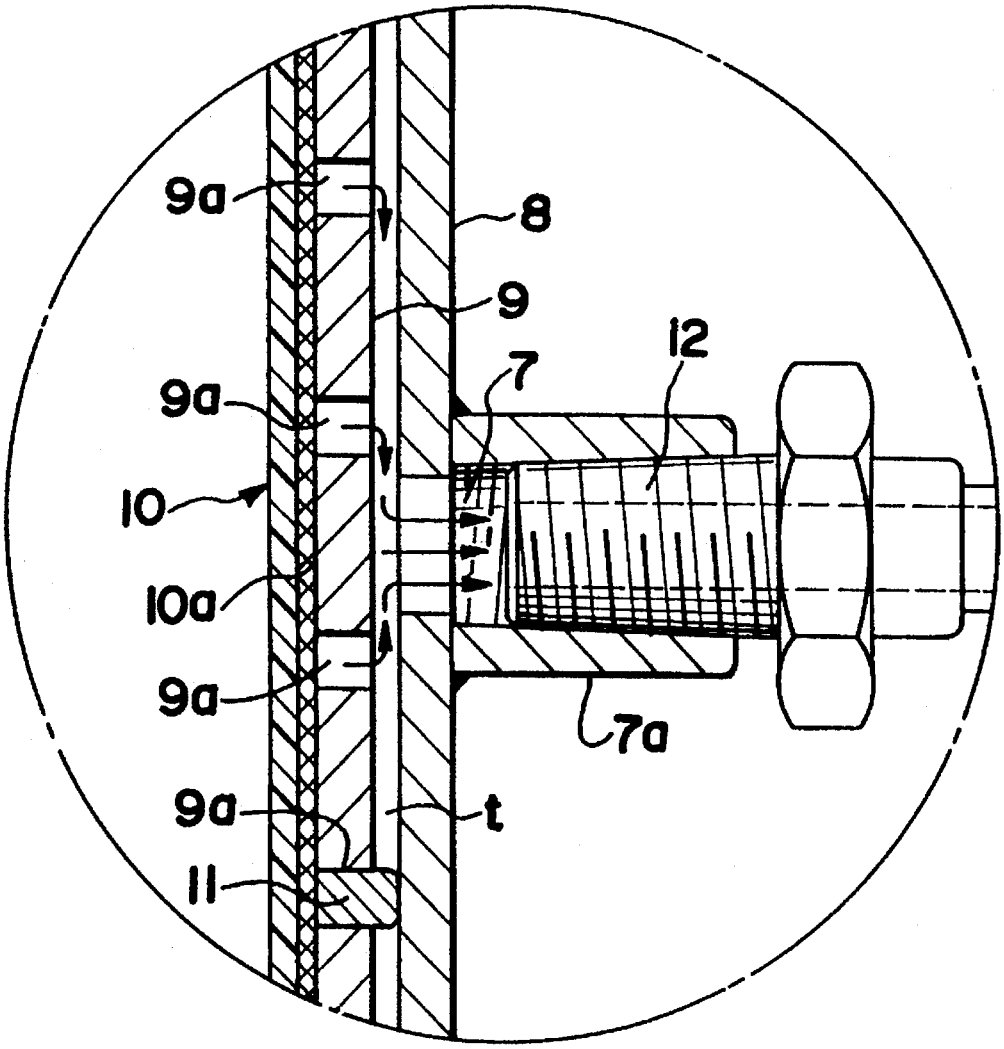
FIG. 2 is an enlarged partial cross-sectional view of the tank interior within the circle line II in FIG. 1.

Thee interior vessel 9, as shown in detail in FIG. 2, is formed from a stainless steel plate, which is provided regularly throughout with a large number of penetration holes 9*a*, and is disposed at a clearance "t" from the exterior shell 8. The lining 10 is suitably a PTFE sheet which is suitably of the material sold by E. I. DuPont de Nemours & Co. under the trademark Teflon, such as Teflon PFA and Teflon FED, and a glass fiber cloth 10*a* embedded in the outer-facing side thereof, and is attached to the entire interior surface of the interior vessel 9, suitably with a rubber-based curable adhesive, such as manufactured by the Nisshin Chemical Co., Ltd. of Japan, under the trade names N-100 through N-500. The glass fiber cloth 10a enhances the adhesion of the lining sheet 10 to the interior of the vessel 9, and reduces the stretching of the lining 10, and also increases its strength. The spot welded spaces 11 between the exterior shell 8 and the interior vessel 9, are inserted through some of the penetration holes 9*a*.

The suction ports 7 of the exterior shell 8 are in communication with the clearance "t" between tile exterior shell 8 and the interior vessel 9. Interior threaded cylindrical pipe junctions 7*a* are attached to the; outer face of the exterior shell 8 over each suction port 7. An adapter 12 for a suction pipe is screwed into each of the pipe junctions 7*a*.

Filtration under reduced pressure is performed with the vacuum tank "A" by connecting the liquid inlet 4 with a gooch funnel (not shown). The interior pressure of the tank body 1 is reduced by vacuum applied through the air vent 3. The suction is exerted on the gooch funnel, and the filtrate is drawn into the tank through the liquid inlet 4. Upon the reduction of the inside pressure in the tank, suction is also applied through he suction ports 7 so that the vacuum is applied through the clearance "t" and through each of the penetration holes 9*a* of the interior vessel 9. This force pulls the lining 10 outwardly against the inward attraction due to the reduction of the inside pressure of the tank body 1. The combination of the suction the penetration holes 9*a* and the adhesion of the liner to the interior wall by the cement, prevents the lining from being pulled into and collapsing in the tank due to the reduced pressure prevailing therein.

Therefore, even if the suction through the suction port 7 would drop or stop all-together, the inward collapse of the entire lining is prevented so that there is more time to take measures to stop application of vacuum to the tank and to effect the required repairs to restore the suction. Suitably, the vacuum applied to the suction port 7 is selected approximately to equal or slightly exceed the vacuum inside the tank body 1.

Figure 3:
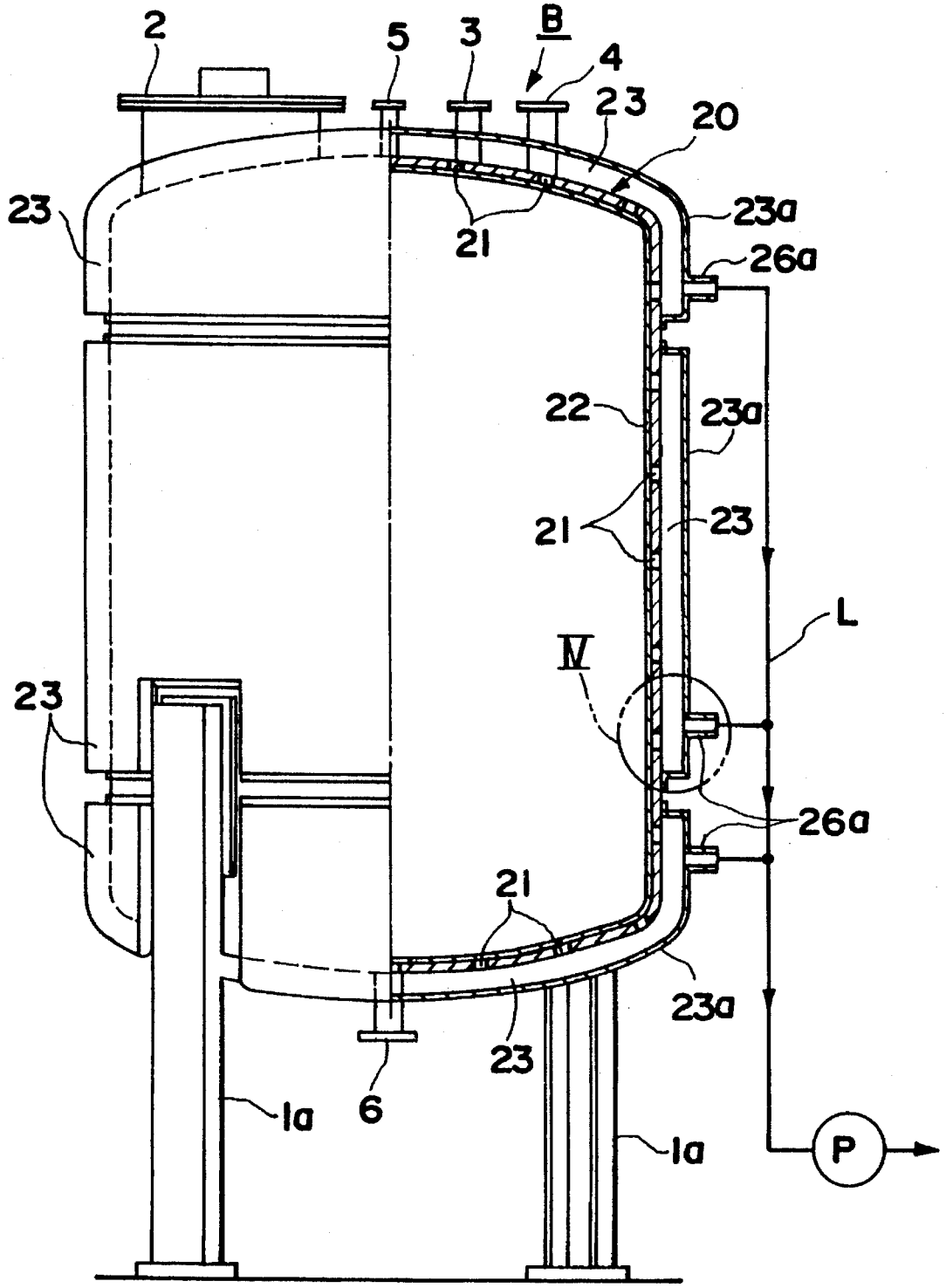
FIG. 3 is a partially cross-sectional elevational view of a second embodiment of the present invention of a lined tank.

A vacuum tank "B" of a second embodiment of the present invention is shown in FIG. 3. This embodiment comprises a suitably 4 mm thick stainless steel tank body 20 which is set upright and supported above the ground by legs la. The tank body 20 has a top part provided with a manhole 2, an air vent 3, a liquid inlet 4, an air brake port 5, and on its bottom it is provided with a liquid outlet 6. In addition, the tank body 20 is provided at regular distances throughout its surface with suction ports 21. A chemically resistant lining sheet 22 is adhesively applied to the entire interior surface of the tank body 20. The outside wall of the tank body 20, particularly at its top, bottom, and circumferential parts, is covered with a plurality of hollow-jackets 23, suitably formed from steel plate 23*a* by bending, and are welded at 24 (FIG. 4) to the outside surface of the tank body 20 to cover all the surface parts 21 from the exterior.

Figure 4:
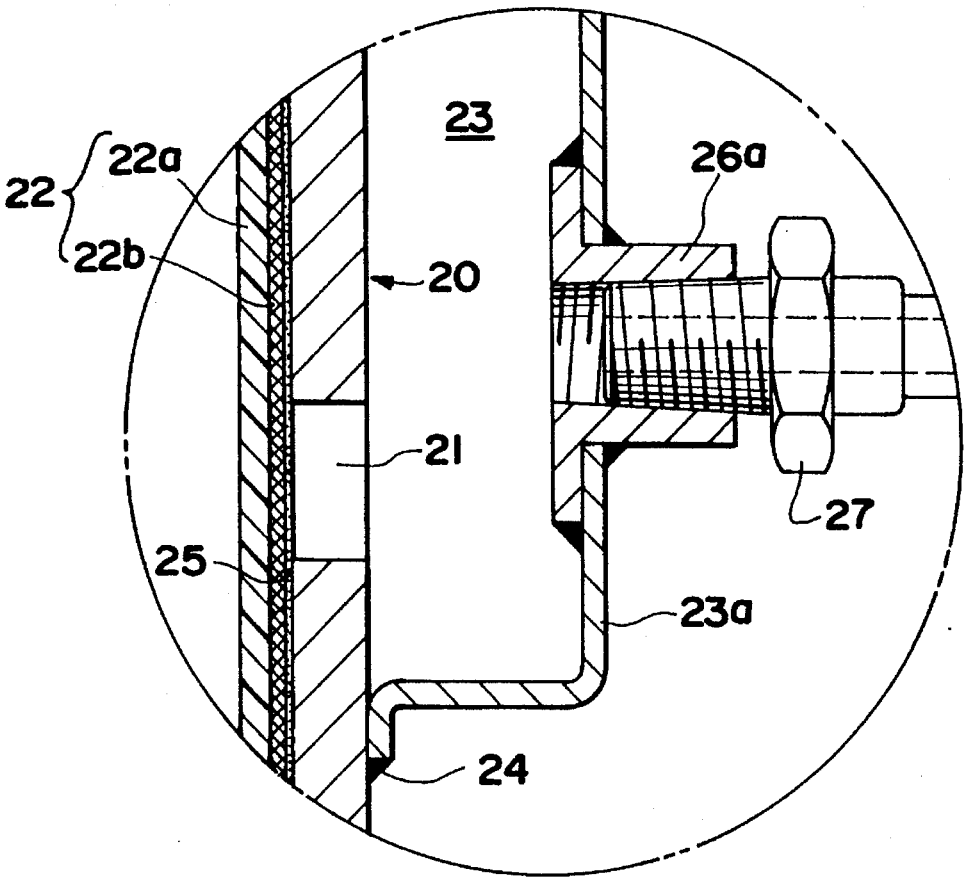
FIG. 4 is an enlarged partial cross-sectional view of the tank interior within the circle IV in FIG. 3.

The lining 22, as shown particularly in FIG. 4, is formed integrally from a thermoplastic fluororesin sheet 22*a*, suitably PTFE, and a glass fiber cloth 22*b* attached to one side thereof, and is adhesively attached to the interior surface of the tank body 20 with a rubber-based curable adhesive 25. More particularly the glass fiber cloth 22*b* of the lining 22 is used for enhancing the adhesion of the lining to the interior surface of the tank body 20, reducing the stretchability of the lining, and increasing its strength. The glass fiber cloth 22*b* is attached to the fluororesin webbing 22*a* by fusion with a thermoplastic fluororesin binder, such as a copolymer of $CF_2{=}CF_2$, and $CF_2{=}CF{-}CF_3$ and/or $CF_2{=}CF{-}ORf$ (wherein Rf is a perfluoroalkyl group), or the glass fiber cloth 22*b* is partly embedded in the fluororesin sheet 22*a* and is further affixed thereto by high temperature.

Suitably the fluororesin sheet 22*a* to from about 0.5–5.0 millimeters thick, or even thicker, and the glass fiber cloth 22*b* suitably weighs from about 100 to about 800 g/m$^2$.

The jackets 23 are provided at prescribed locations with interior threaded cylindrical pipe junctions 26*a*, with an adaptor 27 for a suction pipe "L" being screwed in each junction. The interior pressure of the jackets 23 for this can thus be reduced by vacuum suction of a pump "p" through the suction pipe "L".

Figure 5:
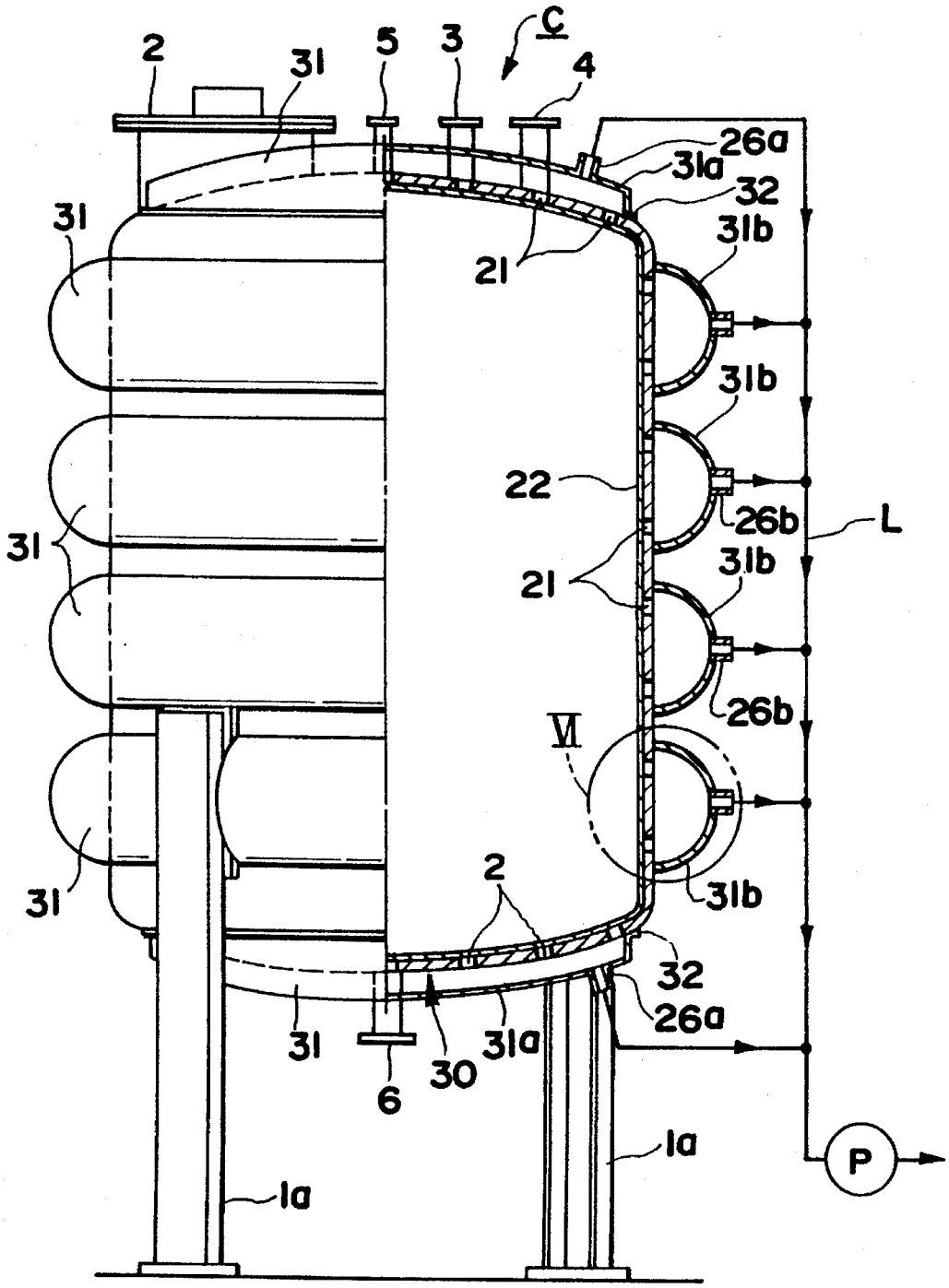
FIG. 5 is a partially cross-sectional elevational view of a third embodiment of a lined tank of the present invention.
Figure 6:
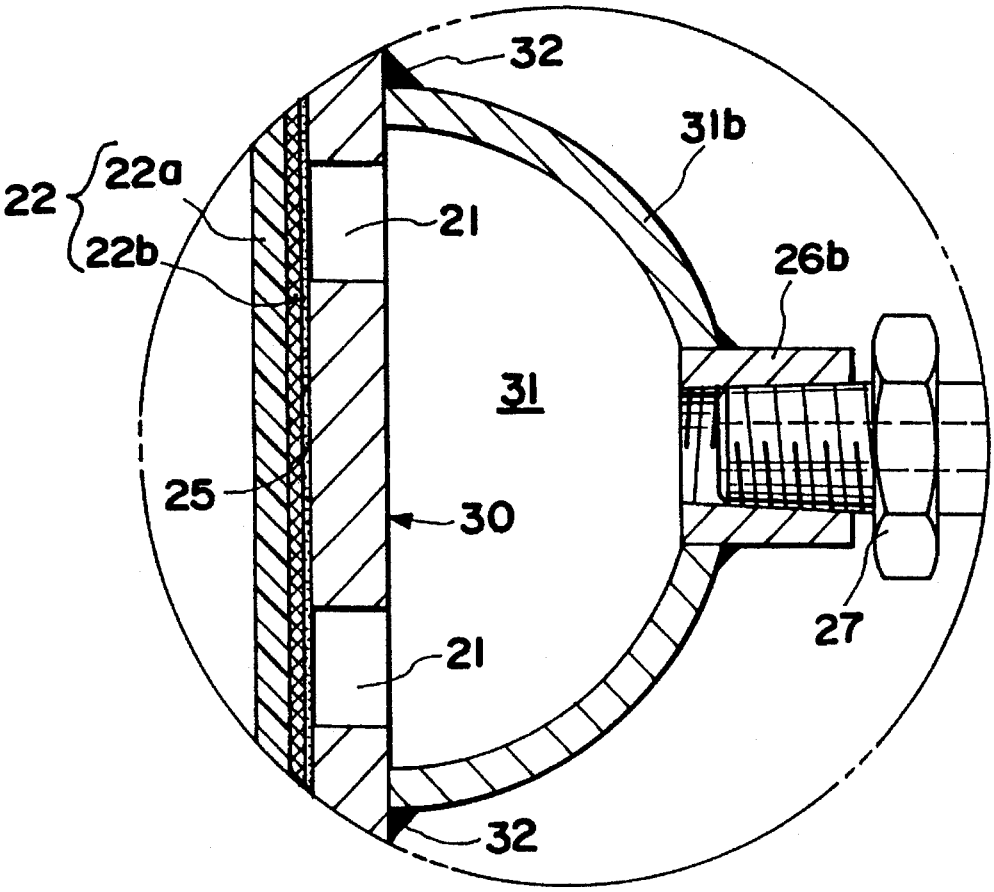
FIG. 6 is a partially cross-sectional view of the tank interior within the circle VI in FIG. 5.

A third embodiment of the present as shown in FIG. 5, comprises a vacuum tank "C" of a tank body 30, constructed similarly to that of the vacuum tank "B" of the second embodiment. As shown in FIG. 6, the interior surface wall has a chemically resistant lining 22 adhesively attached thereto with the cross-linking adhesive 25. The lining 22 is formed from a sheet of fluororesin webbing 22*a* and a glass cloth 22*b* affixed on one side of the webbing. The exterior of the tank body is covered at its top and bottom with a cover jacket 31*a*, prepared by bending steel plate, and being welded at 32 to the top and bottom of the tank body 30. The outside wall in the circumferential part of the tank body 30 is covered with a plurality of peripheral jackets 31*b* having a semicircular cross-section. These jackets 31*b* are formed by dividing a pipe of a larger diameter longitudinally into halves, to cover all the suction parts 21 of the tank body 30. The peripheral jackets 31*b* are arranged parallel to one another to surround the circumference of the tank body 30. The jackets 31*a*, and 31*b*, which collectively constitute the outer jackets 30 of this embodiment of the present invention, are provided with interior threaded pipe connectors 26*a*, and 26*b*, and an adaptor 27 for a suction pipe "L" is screwed in each connector. The interior pressure of the jacket 31 can thus be reduced by the suction of a vacuum pump "p" connected to one end of the suction pipe "L".

With the above-described vacuum tanks "B", and "C" respectively of the second and third embodiments of the present invention, filtration under reduced pressure is performed through the liquid inlet 4, is connected with a gooch funnel (not shown). The interior pressure of the tank bodies 20, and 30 is reduced by suction through the air vent 3, through the gooch funnel, and the filtrate is drawn in through the liquid inlet 4. Upon the reduction of the inside pressures of the tank bodies 20, and 30, the vacuum pump "P" is activated to reduce the pressure in the inside of the jackets 23 and 31 to a value equal to or slightly less than the reduced pressure in the inside of the tank body 1, whereby the suction exerted through the penetration holes 21 on the lining sheet 22 attracts the lining 22 outwardly against the inward attraction due to the reduction of the inside pressure of the tank bodies 20 and 30. Thus, the separation of the lining sheet 22 from the tank bodies 20 and 30, and its protruding or even collapsing inwardly during the working of the tank "B" and "C", is prevented.

As the lining sheet 22 is adhesively attached to the interior surface of the tank bodies 20 and 30, the separation of the lining 22 from the inside surface can be completely prevented by the combination of the entered sucking force from the jackets 23 and 31 and the adhesive action, so that even if the suction from the jackets 23 and 31 is reduced or is dropped, such as due to any malfunction of the vacuum source, there is no likelihood that the lining sheet would collapse inwardly. Therefore, it is possible to take requisite measures without time pressures, such as to stop or to adjust the working tank, or replace the vacuum pump "p".

The simple nature of the present invention permits the retrofitting of existing installations. The lining 22 can be secured to the inside wall of the tank body 20 and 30, readily by the adhesive. The penetration holes 21 can be made in the tank body 20 and 30, readily by punching or drilling holes, and the jackets 23 and 31 can be affixed to the outside wall of the tank body 20 and 30, readily by welding. Therefore, the entire tank can be built at a low cost.

The jackets 23 and 31 of the second and third embodiments can be produced readily by bending of common metal plates and respectively by the cutting of common pipes of a larger diameter into halves. Therefore, the jackets 23 and 31 can also be prepared deeply.

In the embodiments of the present invention, the lining is formed from a sheet of fluororesin and a glass fiber cloth attached to one side thereof. Therefore, the interior surfaces of the tank bodies have a high degree of chemical resistance. They are also free of tackiness, and have the thermal resistance inherent in the fluororesin. Although the fluororesin by itself can generally be poorly adhered, the lining can be fastened to the metallic tank body in such a manner that the glass fiber cloth that is firmly anchored in the lining is in contact with, and adhered firmly to, the inside wall of the tank body with the adhesive. The lining sheet will not wrinkle or shrink from any cause such as the change in temperature during the working of the tank, because the glass fiber cloth restrains the stretchability of the lining and increases its strength.

Although the above-described embodiments are described with reference to the vacuum tank for filtration with a gooch funnel, the present invention is applicable to all types of lined tanks which occasionally are subjected to reduced interior pressure, such as vacuum tanks for other uses, pressure reduction storage tanks for various liquids or other materials, tanks to store solutions under vacuum, and vacuum evaporating or drying containers. Further, changes can be made by various design choices with respect to the shape of the tank body, the divisional arrangement of the jackets, the size, shape and locations of the penetration holes, and the like, without departing from the present invention as defined by the claims.

I claim:

1. A lined tank which comprises a tank body of a wall having an interior surface and an exterior surface, at least one exterior shell over at least part of said tank body, said exterior shell being separated by a clearance from said exterior surface, a plurality of penetration holes ranging through said wall into said clearance, a chemically resistant tank liner having a side adhesively attached to said interior surface, and suction ports in said exterior shell for enabling vacuum drawn through said suction ports to exert a negative pressure on said tank liner through said penetration holes.

2. The lined tank of claim 1, wherein said exterior shell comprises a plurality of separate jackets, each of said jackets having at least one suction port therein, a plurality of said penetration holes being covered by a jacket.

3. The lined tank of claim 2, further comprising suction means for applying a vacuum through said suction ports.

4. The lined tank of claim 2, wherein said jackets are each formed by bending a metal plate to the desired shape, and welding each of said shapes to said exterior surface.

5. The lined tank of claim 2, wherein the tank is a substantially cylindrical tank having a circumference, and said jackets comprise (i) a first jacket for covering the top of the tank, (ii) a second jacket for covering the bottom of the tank, and (iii) a plurality of third jackets for attachment to the circumference of said cylindrical tank.

6. The lined tank of claim 5, wherein each of said third jackets is formed by cutting a pipe having a longitudinal axis substantially along said longitudinal axis, and welding the cut pipe to said exterior surface.

7. The lined tank of claim 1, wherein said liner is a fluororesin sheet having a glass fiber cloth webbing attached to said side of the liner.

* * * * *